US009237811B1

(12) United States Patent
Cho et al.

(10) Patent No.: US 9,237,811 B1
(45) Date of Patent: Jan. 19, 2016

(54) CHAIR WITH IMPROVED WAIST BEARING POWER

(71) Applicants: Hyo Seok Cho, Seoul (KR); Hun Sin, Seoul (KR)

(72) Inventors: Hyo Seok Cho, Seoul (KR); Hun Sin, Seoul (KR)

(73) Assignee: PATRA CO., LTD., Danwon-Gu, Ansan Kyounggi-Do (KR)

( * ) Notice: Subject to any disclaimer, the term of this patent is extended or adjusted under 35 U.S.C. 154(b) by 0 days.

(21) Appl. No.: 14/531,196

(22) Filed: Nov. 3, 2014

(51) Int. Cl.

| | |
|---|---|
| ***A47C 3/025*** | (2006.01) |
| ***A47C 3/026*** | (2006.01) |
| ***A47C 7/44*** | (2006.01) |
| ***A47C 7/14*** | (2006.01) |
| ***A47C 7/00*** | (2006.01) |

(52) U.S. Cl.
CPC . *A47C 7/44* (2013.01); *A47C 7/004* (2013.01); *A47C 7/14* (2013.01)

(58) Field of Classification Search
CPC ..... A47C 7/44; A47C 7/14; A47C 7/004
USPC ..... 297/296, 300.1, 300.2, 300.5, 321, 341, 297/342
See application file for complete search history.

(56) References Cited

U.S. PATENT DOCUMENTS

| | | | | |
|---|---|---|---|---|
| 5,582,459 | A * | 12/1996 | Hama et al. | 297/300.2 |
| 5,660,439 | A * | 8/1997 | Unwalla | 297/300.2 X |
| 5,826,940 | A * | 10/1998 | Hodgdon | 297/300.1 X |
| 6,568,760 | B2 * | 5/2003 | Davis et al. | 297/300.1 X |
| 6,609,755 | B2 * | 8/2003 | Koepke et al. | 297/300.2 |
| 7,249,801 | B2 * | 7/2007 | Tonin | 297/300.5 |
| 8,272,692 | B1 * | 9/2012 | Epperson | 297/296 X |
| 8,646,839 | B2 * | 2/2014 | Moreschi | 297/300.5 |
| 8,998,339 | B2 * | 4/2015 | Peterson et al. | 297/296 X |
| 9,004,597 | B2 * | 4/2015 | Battey et al. | 297/300.5 |
| 9,010,859 | B2 * | 4/2015 | Battey et al. | 297/296 |
| 9,027,997 | B2 * | 5/2015 | Battey et al. | 297/296 X |
| 2007/0108818 | A1 * | 5/2007 | Ueda et al. | 297/296 X |
| 2009/0267394 | A1 * | 10/2009 | Bock | 297/300.2 |
| 2012/0205952 | A1 * | 8/2012 | Takeuchi et al. | 297/300.1 |
| 2014/0103689 | A1 * | 4/2014 | Birkbeck | 297/300.1 |

* cited by examiner

*Primary Examiner* — Rodney B White
(74) *Attorney, Agent, or Firm* — John K. Park; Park Law Firm

(57) ABSTRACT

A chair with improved waist bearing power by self-weight is provided. A chair includes a supporting portion connected to a leg portion, a seat portion with one side connected to the supporting portion, a backrest post with other end installed to the supporting portion fixedly, a backrest frame with the one side connected to a top end of the backrest post, a backrest link having a top end portion inserted into a inserting groove formed in a lower-central rear surface of the backrest frame and a bottom end engaging the seat portion rotatingly, a link fixer connected to the backrest link rotatingly by a connecting axle and installed to the backrest post fixedly, and a backrest installed so as to be connected to the backrest frame and a top end portion of the backrest link and having flexibility.

16 Claims, 9 Drawing Sheets

CHAIR WITH IMPROVED WAIST BEARING POWER

FIELD OF TECHNOLOGY

The present invention relates to a chair with improved waist bearing power, more specifically to a chair with improved waist bearing power by self-weight, in which the tension of backrest with elasticity is controlled automatically by self-weight of the sitter sitting at the seat member so as to support the sitter's waist stably.

BACKGROUND OF INVENTION

In general, a chair, which is used at houses, offices, working environments, etc. for a very long time, includes a chair frame and a seat member, a backrest member, and an armrest disposed at the chair frame.

Recently, as the sitting time increases, it becomes necessary to provide chairs that provide the best sitting feeling and convenience so that the sitter feels reduced fatigue even though he or she sits for a long while.

Especially, since the posture of the sitter gets disordered in cases of long-term working or studying thereon and such disordered postures have the backbone under stresses causing disc problem or bending of backbone, it is very important to guide the sitter to sit on the chair in right postures or to support the waist portion of the sitter.

Chairs with backrests bendable backwards in order to relieve fatigues of the sitter are being used widely, but in such chairs with backrests bendable backwards the portion for supporting the waist disappears when the backrest bends backwards so as to make the sitter's waist portion more uncomfortable, so that the sitter has to use such chairs with a separate cushion put between the backrest and his or her waist, such a cushion may be lost or flattened by long-term usage, which incurs the cost to replace the cushion with a new one.

PRIOR ARTS

Patent Literature (Patent Literature 0001) Korean Registered Patent Number 10-0434997(2004, May 28)

(Patent Literature 0002) Korean Patent Publication Number 10-2009-0017947(2009, Feb. 19)

(Patent Literature 0003) Korean Registered Utility Patent Number 20-0464707(2013, Jan. 9)

(Patent Literature 0004) Korean Registered Patent Number 10-0499792(2005, Jun. 28)

DESCRIPTION OF INVENTION

Problems to Solve

An object of the invention is to provide a chair with improved waist bearing power by self-weight, in which the tension of backrest with elasticity is controlled automatically by self-weight of the sitter sitting at the seat member so as to support the sitter's waist stably.

Another object of the invention is to provide a chair with improved waist bearing power by self-weight, which reduces fatigues in waist or hip portions with the long-term sitting and facilitates the sitter's concentration on the work by having the seat member rotate forwards by a specific angle according to the sitter's sitting postures.

Solutions to Problems

The invention is to provide a chair with improved waist bearing power by self-weight, including a supporting portion connected and installed to a leg portion, a seat portion with one side connected and installed to the supporting portion, a backrest post with other end installed to the supporting portion fixedly, a backrest frame with the one side connected and installed to a top end of the backrest post, a backrest link having a top end portion inserted into a inserting groove formed in a lower-central rear surface of the backrest frame and a bottom end engaging the seat portion rotatingly, a link fixer connected to the backrest link rotatingly by a connecting axle and installed to the backrest post fixedly, and a backrest installed so as to be connected to the backrest frame and a top end portion of the backrest link and having flexibility.

When a user sits on the seat portion, the top end portion and the bottom portion of the backrest link are rotated downwards about the connecting axle as a center by the seat portion, pushes and moves the lower end central portion of the backrest frame in a front direction, and at the same time pulls downwards the backrest connected to the top end portion of the backrest link in a direction of the seat portion, so that the a backrest tension against waist portion of the user sitting on the seat portion is adjusted automatically.

Effects of Invention

In the invention, since the backrest link connected to the seat portion is rotated due to a force (self-weight of the user) applied to the seat portion and one side of the lower-part of the backrest installed in the backrest frame is pulled and operated in a direction of the seat portion by the rotation of the backrest link, an appropriate pressure is applied to the waist of the user sitting on the seat portion, supporting the waist of the user more naturally, reducing the fatigue of user.

The invention can support the waist of user effectively by sitting on the seat portion, and reduce the fatigue of the user.

When the user sits on the seat portion in the invention, since the backrest link pushes the backrest frame in a front direction and rotates so as to pull downwards the backrest in a direction of the seat portion, the backrest tension of the part contacting the back and waist of user increases intensively, and thus supports the waist portion of user tightly and the one side of the backrest positioned at an upper side of waist has relatively a soft state, imparting a comfortable and stable support to the upper parts of the back of user.

In the invention, since the tension of the backrest having a flexibility is controlled automatically by the rotation of the backrest link due to the self-weight of user, and when assembling the backrest to the backrest frame there is no need to control the tension of the backrest too much in order to support the back and waist of user stably, the assembling productivity of backrest can be increased.

In the invention, since the backrest is made of material with flexibility, the supporting force for the waist portion of user can be increased by tension and elasticity.

In the invention, the waist of user may be supported ergonomically and with optimal pressure to each user.

Since the waist portion of user is supported actively, the invention provides comfort, the posture may be prevented from being distorted even for a long-term sitting and pain to the user's waist may be prevented or relieved.

Since the seat portion and the backrest frame where the backrest is installed are connected to each other so as to be able to rotate by the backrest link in the invention, if the user sitting on the seat portion tilts the upper body forwards, the seat portion is configured to tilt forwards and downwards, so that the user can maintain a forward posture easily.

That is, in the invention, since the seat portion is tilted forwards and downwards by the backrest frame, the backrest link, the spring, and the link fixing, when the user takes a forward posture (the user sitting on the seat portion tilts his or her upper body forwards, a stress against waist can be reduced, and the pressure on hips and thighs can be decreased, so as to reduce fatigue.

Also, since maintaining the forward posture minimizes stress to the body and increases concentration, efficiency of work or study can be increased through increasing of the concentration on work of the user.

Since the invention is provided by simple structure that the seat portion and the backrest frame are connected to each other by the backrest link so as to move together, the assembling time decreases, reduces manufacturing cost, facilitates maintenance, gets rid of problems regarding to the user's clothes (being caught, rending, etc.) and the like since there is no element which protrudes outside, and realizes a simple outlook in the sense of visual design.

DETAILED DESCRIPTION OF EMBODIMENTS OF INVENTION

Figure 1:
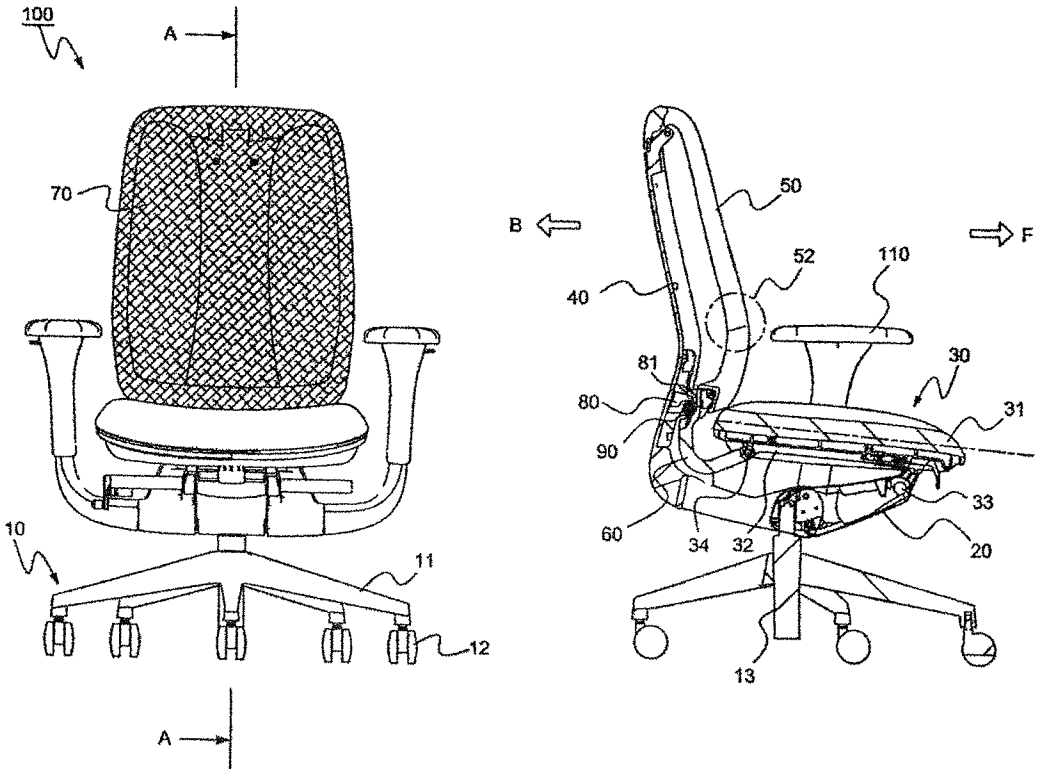
FIG. 1 shows an exemplary structure according to an embodiment of the invention.
Figure 2:
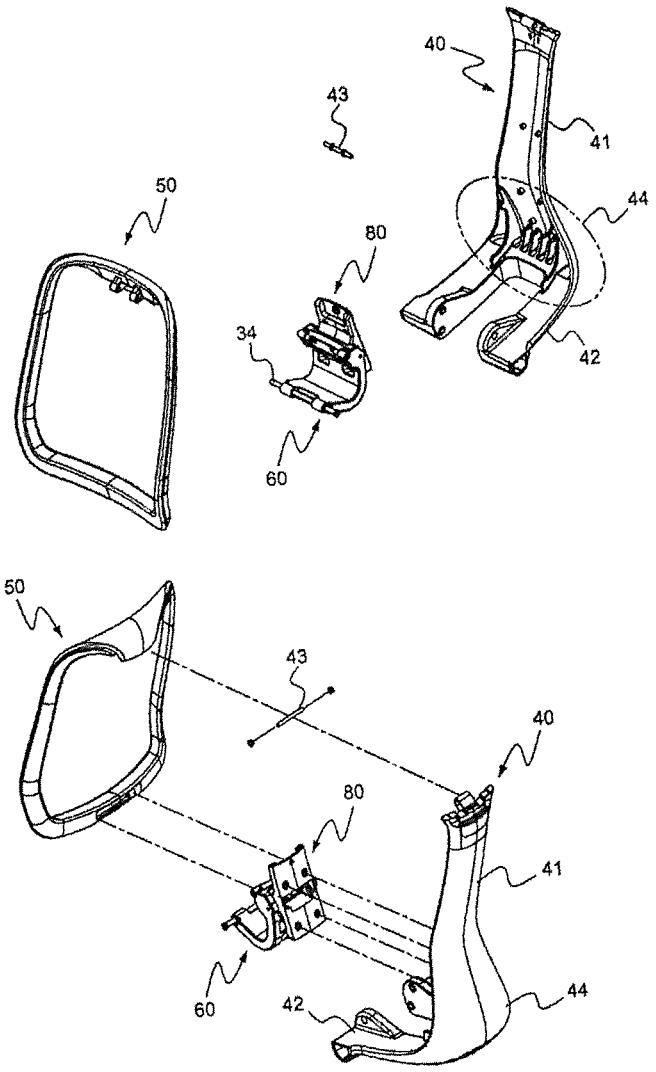
FIG. 2 is an exemplary diagram showing engaging relations (except for seat portion and supporting portion) according to the invention.
Figure 3:
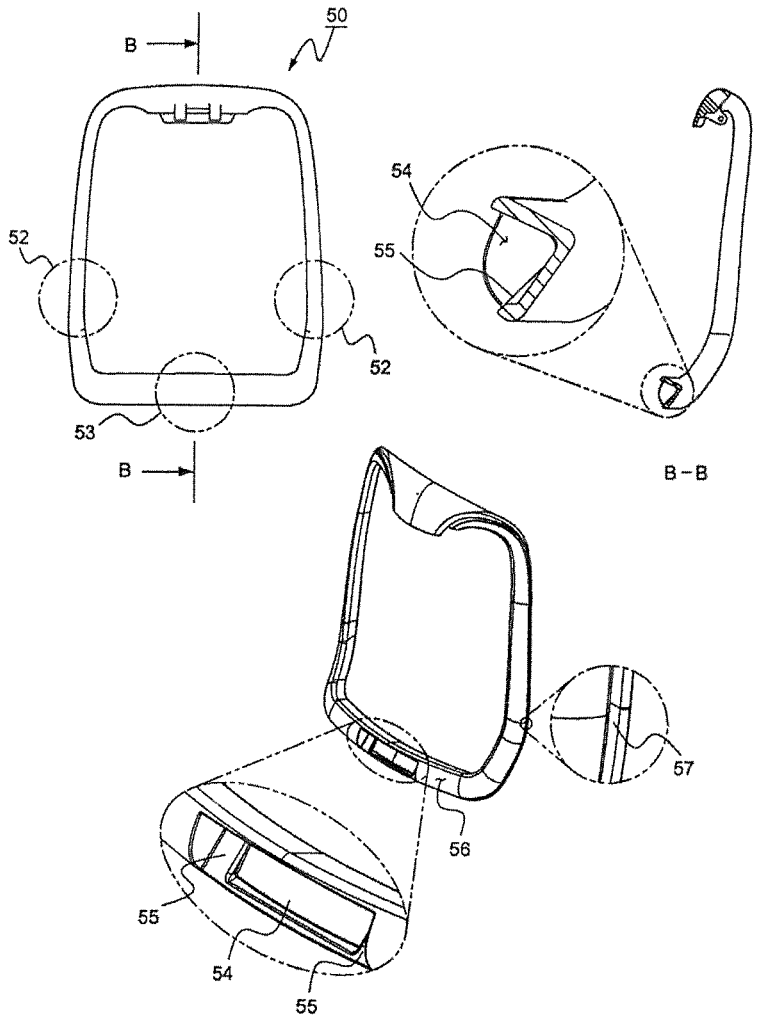
FIG. 3 is an exemplary diagram showing a structure of a backrest frame according to the invention.
Figure 4:
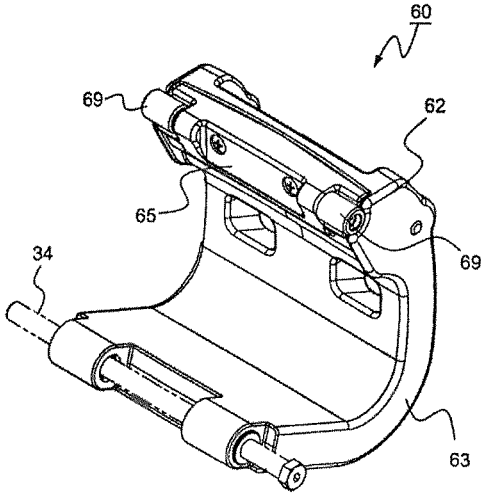
FIG. 4 is an exemplary diagram showing a structure of a backrest link according to the invention.
Figure 5:
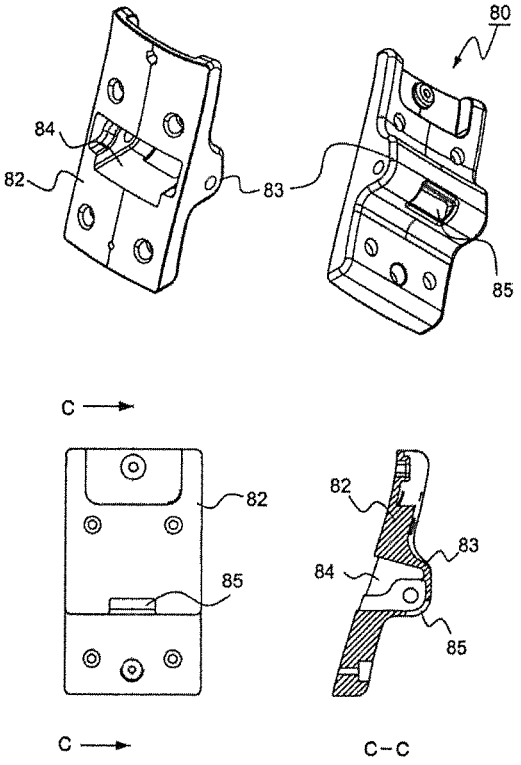
FIG. 5 is an exemplary diagram showing a structure of a link fixer according to the invention.
Figure 6:
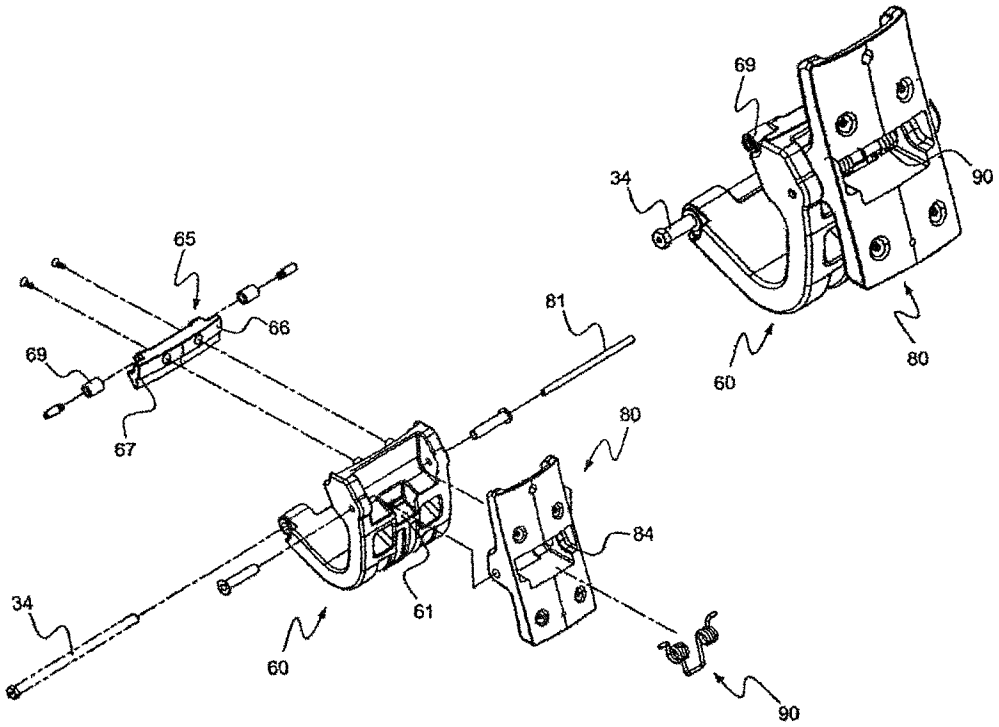
FIG. 6 is an exemplary diagram showing connections of backrest link, link fixer, and spring according to the invention.
Figure 7:
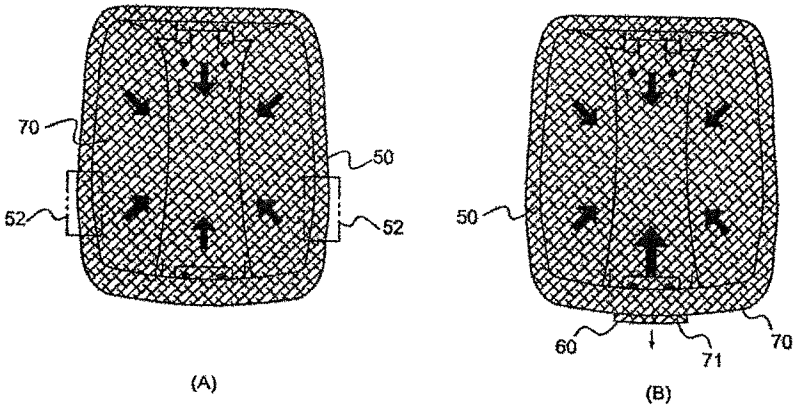
FIG. 7 is an exemplary diagram showing a change of backrest with respect to the operation of backrest link according to the invention.
Figure 8:
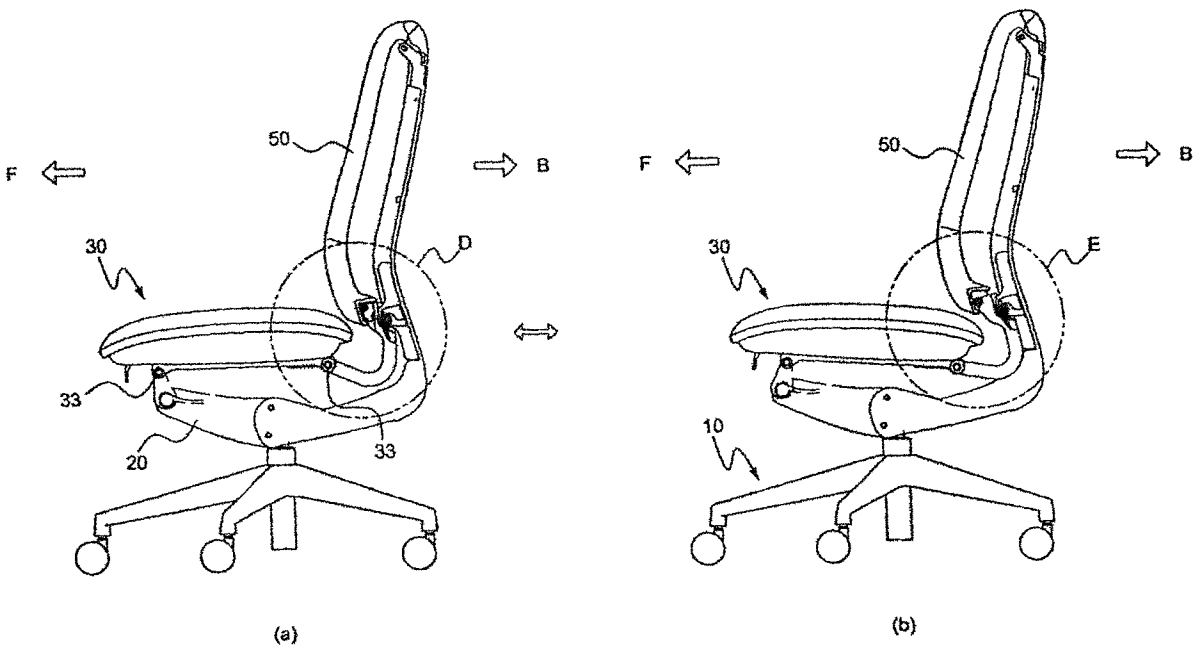
FIG. 8 is an exemplary diagram showing an operation according to the invention.
Figure 9:
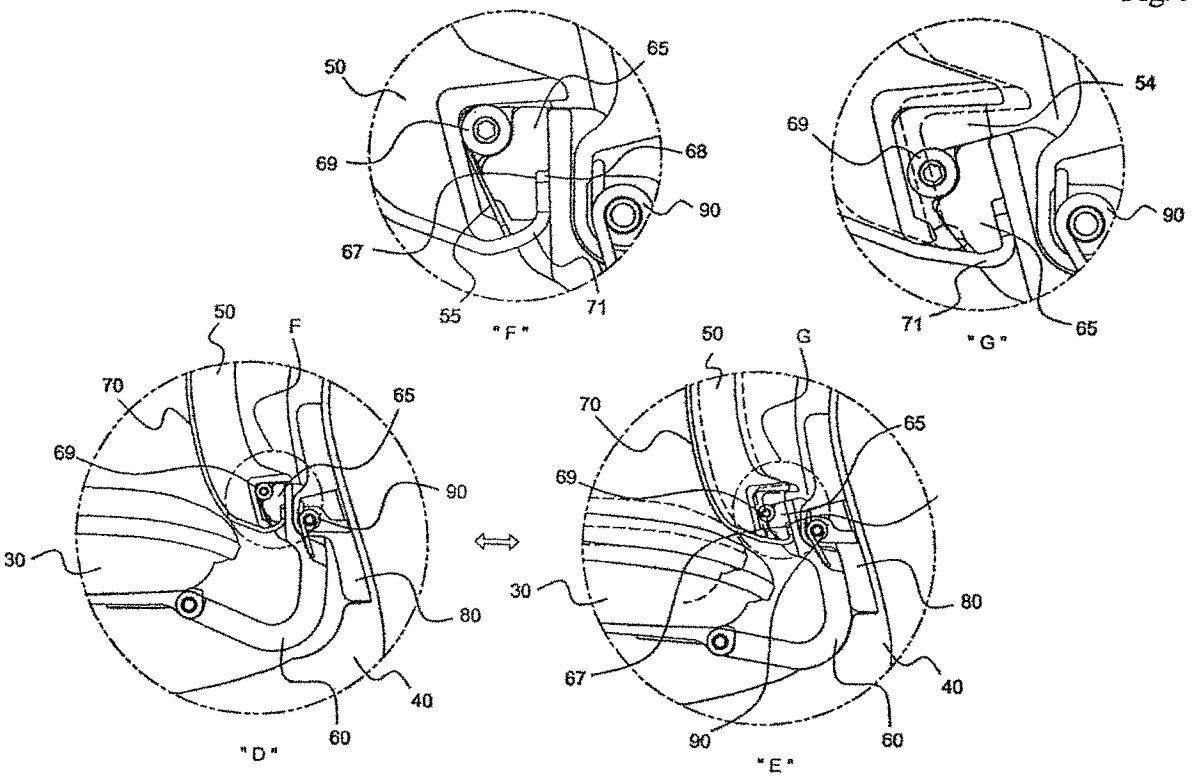
FIG. 9 is a detailed diagram showing "D" and "E" of FIG. 8.
Figure 10:
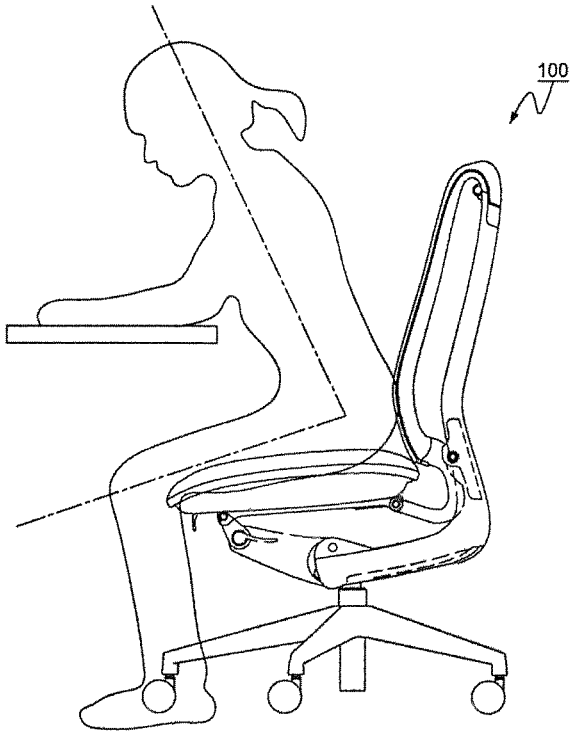
FIG. 10 is an exemplary diagram showing a forward posture of user according to the invention.

FIG. 1 shows an exemplary structure according to an embodiment of the invention, FIG. 2 is an exemplary diagram showing engaging relations (except for seat portion and supporting portion) according to the invention, FIG. 3 is an exemplary diagram showing a structure of a backrest frame according to the invention, FIG. 4 is an exemplary diagram showing a structure of a backrest link according to the invention, FIG. 5 is an exemplary diagram showing a structure of a link fixer according to the invention, FIG. 6 is an exemplary diagram showing connections of backrest link, link fixer, and spring according to the invention, FIG. 7 is an exemplary diagram showing a change of backrest with respect to the operation of backrest link according to the invention, FIG. 8 is an exemplary diagram showing an operation according to the invention, FIG. 9 is a detailed diagram showing "D" and "E" of FIG. 8, and FIG. 10 is an exemplary diagram showing a forward posture of user according to the invention.

A chair with improved waist bearing power by self-weight includes a supporting portion (20) connected and installed to a leg portion (10); a seat portion (30) with a front end lower portion connected and installed to the supporting portion (20) at one end, a backrest post (40) with other end installed to the supporting portion (20) fixedly, a backrest frame (50) with the one side connected and installed to a top end of the backrest post (40), a backrest link (60) having a top end portion inserted into a inserting groove (54) formed in a lower-central rear surface (56) of the backrest frame (50) and a bottom end engaging the rear end lower portion of the seat portion rotatingly, a link fixer (80) connected to the backrest link (60) rotatingly by a connecting axle (81) and installed to the backrest post (40) fixedly, and a backrest (70) installed so as to be connected to the backrest frame (50) and a top end portion (62) of the 60 and having flexibility.

When a user sits on the seat portion (30), the top end portion and the bottom portion of the backrest link (60) are rotated downwards about the connecting axle (81) as a center by the seat portion (30), pushes and moves the lower end central portion (53) of the backrest frame (50) in a front direction (F), and at the same time pulls downwards the backrest (70) connected to the top end portion (62) of the backrest link (60) in a direction of the seat portion (30), so that the a backrest tension against waist portion of the user sitting on the seat portion (30) is adjusted automatically.

Also, the chair according to the invention further includes a spring (90) having one end contacted and supported inside the link fixer (80) and another end penetrating the link fixer (80) and contacted and installed to an end of the backrest link (60) and installed so as to be disposed inside the link fixer (80) by the connecting axle (81).

The leg portion (10) has a plurality of wheel (12)s installed at lower portion of the supporting frame (11), and a central pole (13) for supporting and moving up and down the seat portion (30) and the supporting portion (20) in the center of the supporting frame (11). The central pole (13) includes a cylinder powered by gas pressure, oil pressure, air pressure, etc., and such structures of leg portion are well known in the community, and thus more detailed description is omitted here.

The supporting portion (20) has one side connected to the seat portion (30) through the front-end seat-axle (33) and another side connected and installed to the backrest post (40) and the leg portion (10) respectively, and connected and installed to a top end of the central pole (13) of the leg portion, moving up and down by operation of the central pole (13). The supporting portion (20) has a structure which is used widely to chairs and well known to the public, and thus detailed description is omitted here.

The seat portion (30) comprises a sitting plate (31) on which the user sits and a fixing bracket (32) which is fixed and installed on a lower surface of the sitting plate (31), connected with the supporting portion (20) by the front-end seat-axle (33), and connected with the backrest link (60) by the rear-end seat axle (34).

The backrest post (40), as shown in FIG. 2, includes a bottom post (42) connected to the supporting portion (20) and the a top post (41) having a groove so as to have a specific tilting angle with respect to the bottom post (42), formed integrally, and connected to the backrest frame (50) by the backrest axle (43).

That is, the backrest post (40) is formed such that a top end of the top post (41) is connected to the backrest axle (43) by the backrest frame (50), a connecting portion (44) where the top post (41) and the bottom post (42) are connected to each other is formed so as to be bent downwards in a direction of the supporting portion (20) while retreating in a rear direction (B) of the chair, and end of the bottom post 42) connected and fixed to an end of the bottom post (42) is connected and fixed to the supporting portion (원문 명세서에서 문장 중간에 끝김 )

The backrest post (40) formed as in the above provides an "L" shape defined by the bottom post (42) and the top post (41), and is formed integrally.

The backrest frame (50) is where the backrest (70) is connected and installed so as to support, and as shown in FIGS. 1 and 3, one side of a top end is connected to a top end of the 40 by the backrest axle (43), and at a lower-end central rear surface (56) is formed the inserting groove (54) having a shape opened in a direction downward or rearward (B).

The inserting groove (54) is where a top end (62) of the backrest link (60) is inserted and contacted, and formed with the contacting-slope surface (55) on which one side of the backrest link top end (62) is contacted with pressure and moves.

Also, the backrest frame (50) is formed protrudingly such that the contacting portion (52) positioned at a height same as waist portion of the user is bent convexly in the front direction (F), that is, in a direction that the sitter's back is bent outward.

The backrest link (60), as shown in FIGS. 4 and 6, is connected and installed to the link fixer (80) through the connecting axle (81), an end of the bottom end portion (63) is connected and installed to the seat portion (30) through the rear-end seat axle (34) rotatingly, the roller cover (65) is bolt-engaged to the top end portion (62) forming the backrest inserting groove (68), and at both sides of the inserting groove (54) is installed rotatingly the pressure roller (69) for rolling along the contacting-slope surface (55) of the inserting groove (54).

The top end portion (62) and the bottom end portion (63), when assembling the backrest link (60) and the link fixer (80), are called as a top end portion for the part positioned on a top side with respect to the connecting axle (81) as a center and as a bottom end portion at a bottom side, and formed integrally.

The roller cover (65) is bolt-engaged to the top end portion (62) forming the backrest inserting groove (68), and, as shown in FIGS. 6 and 9, formed such that the bottom portion provides a step (67) at the cover rear surface (66) contacting the top end portion (62), and when bolt-engaging to the top end portion (62), through the backrest inserting groove (68)*b*, between the one side of the top end portion (62) and the cover rear surface (66) contacting thereto is formed the backrest inserting groove (68) opened downwards. The backrest inserting groove (68) is fixed with the lower end central part of the backrest inserted and engaged.

The pressure roller (69) is installed rotatingly on both sides of the roller cover (65), contacts the contacting-slope surface (55) formed so as to be positioned on both sides of the inside of the inserting groove (54) when the one side of the top end portion (62) of the backrest link (60) is inserted into the inserting groove (54) of the backrest frame, and moves up and down along a contacting tilt surface pushing the contacting tilt surface.

The backrest link (60) formed as in the above is formed so as to provide a 'C' shape in general, and the middle portion is connected and installed to the link fixer (80) rotatingly through the connecting axle (81), such that the top end portion (62) to where the roller cover (65) is installed and the bottom end portion (63) connected to the seat member so as to rotate upwards or downwards with the connecting axle (81) as a center.

Also, when the backrest link (60) rotates around the connecting axle (81) as a center, one side of the top end portion (62) or the bottom end portion (63) contacts the link fixer (80) respectively limiting the rotational radius.

The backrest (70) is made of flexible material such as fabric, net or mesh, etc., as shown in FIGS. 7 and 9, fixed and installed to the backrest frame (50) providing a specific strain, and the partially cut lower-central portion (71) is inserted and fixed inside the backrest inserting groove (68) of the backrest link (60).

That is, the backrest (70) is formed so that the lower-central portion (71) is partially cut, the remaining part except the lower-central portion (71) is fixed along the backrest frame (50), and the lower-central portion (71) is installed so as to be inserted and fixed inside the backrest inserting groove (68).

There, preferably, the lower-central portion (71) of the backrest is installed so that the end is fixed in the backrest inserting groove (68), and engaging of the lower-central portion (71) of the backrest and the backrest inserting groove (68) is performed by insert-and-engaging through a inserting member (strip).

Also, the connecting installation of the backrest (70) is performed through well-known methods such as cover-connect-installing or insert-connect-installing etc. using an inserting material (strip etc.), or fixed and installed to the backrest frame by bolt-engaging and the like, detailed description of which being omitted here.

Also, in the case that the backrest is connected and installed in the backrest frame by the inserting member (strip), the inserting groove (57) may be formed so that the backrest is inserted and engaged along the perimeter of the backrest frame.

The backrest (70) is connected and installed to the backrest frame (50) and the backrest link (60), and the strain against the waist-contacting portion is adjusted by the self-weight of the user sitting on the seat portion (30), supporting the waist portion of the user.

That is, since the backrest (70) is connected and installed to the backrest frame (50) and the lower-central portion (71) that is cut partially and formed is connected to the backrest link (60), when the top end portion (62) of the backrest link (60) rotates downwards, that is, in a direction of the seat portion (30) about the connecting axle (81) as a center, the lower-central portion (71) of the backrest is pulled in a direction of the seat portion (30) by the top end portion (62) of the backrest link. Also, since the strain of the backrest (70) formed as in the above generates a torque in a direction to rotate the top end portion (62) of the backrest link (60) upwards about the connecting axle (81) as a center, a strain is acted (generated) upwards or downwards with respect to the central portion of the backrest, supporting the waist portion of the user stably or solidly.

Since the link fixer (80) supports the backrest link (60) rotatingly by the connecting axle (81) and one side of the top end portion (62) or the bottom end portion (63) contacts so as to limit the radius of rotation of the backrest link (60), as shown in FIGS. 1 and 2, the link fixer (80) is fixed and installed in the backrest post (40) so as to be positioned between the backrest post (40) and the backrest link (60), the body (82) is fixed through bolt at the backrest post (40), and the protruding engaging platform (83) engaged by the backrest link (60) and the connecting axle (81) is formed so as to protrude from the body (82).

That is, the backrest link (60) is axle-engaged to the protruding engaging platform (83) of the link fixer (80) rotatingly by the connecting axle (81) and the top end portion (62) or the bottom end portion (63) of the backrest link (60) rotating about the connecting axle (81) are contacted to one side of the link fixer (80) positioned at the top and bottom portions of the protruding engaging platform (83) respectively, limiting the radius (angle) of rotation.

In a 100 according to the invention formed as in the above, the supporting portion (20) is connected in the leg portion (10), the backrest post (40) is connected to the supporting portion (20), and the backrest post (40) and the 50 are connected by the backrest axle (43).

Also, the supporting portion (20) and the seat portion (30) are connected by the front-end seat-axle (33), the seat portion and the backrest link (60) are connected to the rear-end seat axle (34), and the backrest link (60) is connected rotatingly to the link fixer (80) that is fixed and installed to the backrest post (40) by the connecting axle (81).

Also, since the backrest frame (50) and the backrest link (60) are connected so that the pressure roller (69) of the backrest link into the inserting groove (54) of the backrest frame, and the backrest (70) is connected and installed to the backrest frame (50) and the backrest link (60), each of the seat portion (30), the backrest link (60), the backrest frame (50), the backrest post (40), and the supporting portion (20) can rotate about each of axle connected thereto as a center, and when the user sits on the seat portion (30) the locations of the backrest frame (50) and the seat portion (30) change through connected movements, and furthermore the backrest link (60) rotates about the connecting axle (81) as a center and pushes and move the lower end central portion (53) of the backrest frame (50) in the front direction (F), and at the same time, pulled the lower-central portion (71) of the backrest downwards, varying the strain of the backrest.

Also, in the invention, as shown in FIGS. 2, 6, and 8, a spring (90) may further be installed between the link fixer (80) and the backrest link (60), and the spring (90) is installed in the link fixer (80) by the connecting axle (81) so as to provide an elastic force for moving the bottom end portion (63) of the backrest link about the connecting axle (81) as a center upwards.

That is, both ends of the spring (90) are contacted and supported to the link fixer (80) and the central portion thereof is contacted and supported to one side of the backrest link (60) and installed in the link fixer (80), so as to provide an elastic force for rotating the bottom end portion (63) of the backrest link upwards. Such spring (90) may include a torsion spring.

Also, since the spring (90) is just to be installed in the link fixer (80) so as to deliver the elastic force to the backrest link (60), the structure of the link fixer (80) according to installation of the spring (90) doesn't have to be limited to a special case, but as shown in FIG. 5 the link fixer (80), the spring installing groove (84) with the spring (90) inserted inside is formed, and preferably a spring through-hole (85) is formed so that one side of the spring (90) is penetrated through the protruding engaging platform (83) of the link fixer and contacted and supported at one side of the backrest link (60) in order to be connected to the spring installing groove (84). Also, in the backrest link (60) is further formed the spring support hole (61) where the spring is contacted and supported.

That is, if the link fixer (80) is formed as in the above, the spring (90) is installed to be positioned in the spring installing groove (84) of the link fixer by the connecting axle (81) so as to provide an elastic force for moving upwards the top end portion (62) of the backrest link where the roller cover (65) is installed around the connecting axle (81) as a center.

Both side ends of the spring (90) is contacted and supported at one side inside the spring installing groove (84), the middle portion is installed so as to penetrate the spring through-hole (85) and protrude outside the link fixer, and the middle portion of the spring penetrating the spring through-hole (85) and protruding as such is contacted and supported at one side of rear surface of the bottom end portion (63) of the backrest link (60) (or spring support hole).

As in the above, if the spring (90) is further installed between the backrest link (60) and the link fixer (80), since the force to rotate the backrest link (60) gets stronger for making the bottom end portion (63) of the backrest link (60), that is, the portion connected to the seat portion (30) rotated and raised about the connecting axle (81) as a center by the elastic force of the spring (90), the recovering force to an initial state (a state before the user sits on the chair or a state of seat portion of forward posture) gets increased.

That is, since the backrest link (60) rotates about the connecting axle (81) as a center by the backrest strain and the elastic force of the spring (90) and the rear end portion of the seat portion (30) connected to rear-end seat axle (34) is raised, a state in which the seat portion (30) is tilted downwards in the front direction (F) (a state in which the user can sit on conveniently in a right posture) is provided.

Also, if the user sits on the seat portion, since the backrest link (60) presses the spring (90) and rotates, colliding forces among the components. The elements (110) are armrests of the chair.

Below, operational relations according to the invention are as follows.

When the user does not sits on the chair

In a state that the backrest frame, the backrest, the backrest post, the link fixer, and the backrest link are assembled, as shown in FIG. 7(*a*), a force is generated, which makes the strain act in a central direction of the backrest by the flexibility (elasticity) of the backrest so that such strain of the backrest makes the bottom end portion of the backrest link connected to the seat portion rotated and raised about the connecting axle as a center. (elevating of the rear end of the seat portion where the rear end seat axle is positioned about the front end seat axle as a center)

That is, as shown in FIGS. 8(*a*) and 9, the top end portion of the backrest link where the backrest is connected and installed is positioned in the inserting groove of the backrest frame by the strain of the backrest, and if a state in which the backrest link and the backrest frame are engaged as such, since the bottom end portion of the backrest link connected to the seat portion also maintains a state of elevated and rotated about the connecting axle, the rear end portion of the seat portion connected to the backrest link is raised by the rear end seat axle, providing a state in which the seat portion is sloped tilting downwards in the front direction (F).

Such a state of the seat portion is to make the hip portion of the user get closer to the backrest portion, that is, sit easily with a right posture.

Also, since the backrest link rotating about the connecting axle as a center can rotate by a specific angle because one side contacts the link fixer, when the user does not sit, the seat portion provide the same state all the time.

Also, in a case that the spring is installed, since a force rotating the backrest link acts together with the strain of the backrest so that the bottom end portion of the backrest link is raised about the connecting axle as a center by the elastic force of the spring, the rear end portion of the seat portion is raised so that a state in which the seat portion is sloped tilting downwards in the front direction (F) is provided much more easily.

When the user sits on the chair

If the user sits on the seat portion, as shown in FIGS. 8(*b*) and 9, the seat portion rotates downwards in a direction of the leg portion about the front end seat axle by the self-weight of the user, ad the bottom end portion of the backrest link rotates downwards in a direction of the backrest post by the seat portion's downward rotation about the connecting axle as a center. At this moment, since the top end portion of the backrest link also rotates downwards in the direction of the seat portion about the connecting axle as a center, the pressure roller of the backrest link pushes the contacting slope surface and moves rolling so that the lower portion of the backrest frame moves by a specific distance in the front direction, and at the same time, as shown in FIG. 7(*b*), the bottom end central portion of the backrest connected to the backrest link gets pulled downwards, more precisely downwards in the front direction.

AS such, if the bottom central part of the backrest frame is moved in the front direction (F) and the bottom end central portion of the backrest is pulled by the backrest link by the rotation of the backrest link, the strain of the backrest, especially the strain of the backrest connected and installed at the portion and the contacting portion where the user's backbone is positioned is increased, the supporting force on the waist of the user sitting on the seat portion.

Also, since the bottom end portion of the backrest link rotating downwards about the connecting axle as a center has one side contacted to the backrest post or the link fixer, when the user sits on the chair, the seat portion rotates by a specific angle only, providing a constant state.

When the user maintains a forward posture

FIG. 10 shows an exemplary diagram of a forward posture of user according to the invention, and the forward posture increases the concentration of the user on work, minimizes the burden on the user, and reduces the stress on the user's waist and pressure on the hip and thighs, reducing the user's fatigue.

That is, in the invention, if the user tilts the upper body forwards while sitting on the seat portion, since the seat portion rotates and moves about the front end axle as a center and the rear end of the seat portion is raised by the movement of the center of mass of the user, the seat portion maintains a state tilting forwards tilting downwards and the user can maintain the sitting state.

Such a state of the seat portion reduces a burden on the user's waist and pressure on the thighs, minimizing the burden on the user's body and increasing the concentration.

While the invention has been shown and described with reference to different embodiments thereof, it will be appreciated by those skilled in the art that variations in form, detail, compositions and operation may be made without departing from the spirit and scope of the invention as defined by the accompanying claims.

LEGENDS (10): leg portion
(11): supporting frame
(12): rotating wheel
(13): central pole
(20): supporting portion
(30): seat portion
(31): sitting plate
(32): fixing bracket
(33): front-end seat-axle
(34): rear-end seat-axle
(40): backrest post
(41): top post
(42): bottom post
(43): backrest post
(44): connecting portion
(50): backrest frame
(52): contacting portion
(53): lower-end central portion
(54): inserting portion
(55): contacting-slope surface
(56): lower-central rear surface
(60): backrest link
(61): spring support hole
(62): top end portion
(63): bottom end portion
(65): roller cover
(66): cover rear surface
(67): step
(68): backrest inserting groove
(69): pressure roller
(70): backrest
(71): lower-central portion
(80): link fixer
(81): connecting axle
(82): body
(83): protruding engaging platform
(84): spring installing groove
(85): spring through-hole
(90): spring (90)
(100): chair

What is claimed is:

1. A chair with improved waist bearing power by self-weight, the chair comprising:

a supporting portion (20) connected and installed to a leg portion (10);

a seat portion (30) with one side connected and installed to the supporting portion (20);

a backrest post (40) with an end installed to the supporting portion (20) fixedly;

a backrest frame (50) with the one side connected and installed to a top end of the backrest post (40);

a backrest link (60) having a top end portion inserted into a inserting groove (54) formed in a lower-central rear surface (56) of the backrest frame (50) and a bottom end engaging the seat portion rotatingly;

a link fixer (80) connected to the backrest link (60) rotatingly by a connecting axle (81) and installed to the backrest post (40) fixedly; and a backrest (70) installed so as to be connected to the backrest frame (50) and a top end portion (62) of the backrest link (60) and having flexibility, wherein when a user sits on the seat portion (30), the top end portion and the bottom end of the backrest link (60) are rotated downwards about the connecting axle (81) as a center by the seat portion (30), pushes and moves a lower end central portion (53) of the backrest frame (50) in a front direction (F), and at the same time pulls downwards the backrest (70) connected to the top end Portion (62) of the backrest link (60) in a direction of the seat portion (30), so that backrest tension against a waist portion of the user sitting on the seat portion (30) is adjusted automatically, further comprising a spring (90) having one end contacted and supported inside the link fixer (80) and another end penetrating the link fixer (80) and contacted and installed to an end of the backrest link (60) and installed so as to be disposed inside the link fixer (80) by the connecting axle (81).

2. A chair with improved waist bearing power by self-weight, the chair comprising:

a supporting portion (20) connected and installed to a leg portion (10);

a seat portion (30) with one side connected and installed to the supporting portion (20);

a backrest post (40) with an end installed to the supporting portion (20) fixedly;

a backrest frame (50) with the one side connected and installed to a top end of the backrest post (40);

a backrest link (60) having a top end portion inserted into a inserting groove (54) formed in a lower-central rear surface (56) of the backrest frame (50) and a bottom end engaging the seat portion rotatingly;

a link fixer (80) connected to the backrest link (60) rotatingly by a connecting axle (81) and installed to the backrest post (40) fixedly; and a backrest (70) installed so as to be connected to the backrest frame (50) and a top end portion (62) of the backrest link (60) and having flexibility, wherein when a user sits on the seat portion (30), the top end portion and the bottom end of the backrest link (60) are rotated downwards about the connecting axle (81) as a center by the seat portion (30), pushes and moves a lower end central portion (53) of the backrest frame (50) in a front direction (F), and at the same time pulls downwards the backrest (70) connected to the top end portion (62) of the backrest link (60) in a direction of the seat portion (30), so that backrest tension against a waist portion of the user sitting on the seat portion (30) is adjusted automatically, wherein the link fixer (80) is formed with a spring installing groove (84) into which the spring (90) is inserted inside and a spring through-hole (85) for one side of the spring (90) to be inserted to a protruding engaging platform (83) of the link fixer (80) and to be contacted and supported to one side of the backrest link (60) so as to be bored to the spring installing groove (84).

3. The chair with improved waist bearing power by self-weight of claim 2, wherein the backrest post (40) comprises a bottom post (42) connected to the supporting portion (20) and a top post (41) having a curve so as to form a specific angle with respect to the bottom post (42), formed integrally, and having the backrest frame (50) connected by a backrest axle (43).

4. The chair with improved waist bearing power by self-weight of claim 2, wherein the inserting groove (54) is formed with a contacting-slope surface (55) both sides of which one side of the top end portion (62) of the backrest link (60) contacts with pressure.

5. The chair with improved waist bearing power by self-weight of claim 2, wherein the backrest (70) is formed so that a lower-central portion (71) is cut out partially, a remaining portion except for a lower-central portion (71) is installed fixedly to the backrest frame (50), and the lower-central portion (71) is installed so as to be inserted and fixed to inside of the backrest inserting groove (68).

6. The chair with improved waist bearing power by self-weight of claim 1, wherein the backrest post (40) comprises a bottom post (42) connected to the supporting portion (20) and a top post (41) having a curve so as to form a specific angle with respect to the bottom post (42), formed integrally, and having the backrest frame (50) connected by a backrest axle (43).

7. The chair with improved waist bearing power by self-weight of claim 1, wherein the inserting groove (54) is formed with a contacting-slope surface (55) both sides of which one side of the top end portion (62) of the backrest link (60) contacts with pressure.

8. A chair with improved waist bearing power by self-weight, the chair comprising:

a supporting portion (20) connected and installed to a leg portion (10);

a seat portion (30) with one side connected and installed to the supporting portion (20);

a backrest post (40) with an end installed to the supporting portion (20) fixedly;

a backrest frame (50) with the one side connected and installed to a top end of the backrest post (40);

a backrest link (60) having a top end portion inserted into a inserting groove (54) formed in a lower-central rear surface (56) of the backrest frame (50) and a bottom end engaging the seat portion rotatingly;

a link fixer (80) connected to the backrest link (60) rotatingly by a connecting axle (81) and installed to the backrest post (40) fixedly; and a backrest (70) installed so as to be connected to the backrest frame (50) and a top end portion (62) of the backrest link (60) and having flexibility, wherein when a user sits on the seat portion (30), the top end portion and the bottom end of the backrest link (60) are rotated downwards about the connecting axle (81) as a center by the seat portion (30), pushes and moves a lower end central portion (53) of the backrest frame (50) in a front direction (F), and at the same time pulls downwards the backrest (70) connected to the top end Portion (62) of the backrest link (60) in a direction of the seat portion (30), so that backrest tension against a waist portion of the user sitting on the seat portion (30) is adjusted automatically, wherein the backrest link (60) is contacted and installed to the link fixer (80) rotatingly by the connecting axle (81), an end of the bottom end portion (63) is contacted and installed to the seat portion (30) rotatingly by the rear-end seat axle (34), a backrest inserting groove (68) is formed in the top end portion (62) by bolt-engaged roller cover (65), and a pressure roller (69) rolling in the inserting groove (54) of the backrest frame (50) is installed on both sides of the roller cover (65) rotatingly.

9. The chair with improved waist bearing power by self-weight of claim 8, wherein the backrest post (40) comprises a bottom post (42) connected to the supporting portion (20) and a top post (41) having a curve so as to form a specific angle with respect to the bottom post (42), formed integrally, and having the backrest frame (50) connected by a backrest axle (43).

10. The chair with improved waist bearing power by self-weight of claim 8, wherein the inserting groove (54) is formed with a contacting-slope surface (55) both sides of which one side of the top end portion (62) of the backrest link (60) contacts with pressure.

11. The chair with improved waist bearing power by self-weight of claim 8, wherein the backrest (70) is formed so that a lower-central portion (71) is cut out partially, a remaining portion except for a lower-central portion (71) is installed fixedly to the backrest frame (50), and the lower-central portion (71) is installed so as to be inserted and fixed to inside of the backrest inserting groove (68).

12. A chair with improved waist bearing power by self-weight, the chair comprising:

a supporting portion (20) connected and installed to a leg portion (10);

a seat portion (30) with one side connected and installed to the supporting portion (20);

a backrest post (40) with an end installed to the supporting portion (20) fixedly;

a backrest frame (50) with the one side connected and installed to a top end of the backrest post (40);

a backrest link (60) having a top end portion inserted into a inserting groove (54) formed in a lower-central rear surface (56) of the backrest frame (50) and a bottom end engaging the seat portion rotatingly;

a link fixer (80) connected to the backrest link (60) rotatingly by a connecting axle (81) and installed to the backrest post (40) fixedly; and a backrest (70) installed so as to be connected to the backrest frame (50) and a top end portion (62) of the backrest link (60) and having flexibility, wherein when a user sits on the seat portion (30), the top end portion and the bottom end of the backrest link (60) are rotated downwards about the connecting axle (81) as a center by the seat portion (30), pushes and moves a lower end central portion (53) of the backrest frame (50) in a front direction (F), and at the same time pulls downwards the backrest (70) connected to the top end Portion (62) of the backrest link (60) in a direction of the seat portion (30), so that backrest tension against a waist portion of the user sitting on the seat portion (30) is adjusted automatically, wherein a roller cover (65) is installed so that a bottom portion of the roller cover (65) comprises a step (67) on a cover rear surface (66) contacting with the top end portion (62), and when the roller cover (65) bolt-engages with the top end portion (62) by the step (67), a backrest inserting groove (68) opened downwards between one side surface of the top end portion (62) and the cover rear surface (66) contacting thereto is formed.

13. The chair with improved waist bearing power by self-weight of claim 12, wherein the backrest post (40) comprises a bottom post (42) connected to the supporting portion (20) and a top post (41) having a curve so as to form a specific angle with respect to the bottom post (42), formed integrally, and having the backrest frame (50) connected by a backrest axle (43).

14. The chair with improved waist bearing power by self-weight of claim 12, wherein the inserting groove (54) is formed with a contacting-slope surface (55) both sides of which one side of the top end portion (62) of the backrest link (60) contacts with pressure.

15. The chair with improved waist bearing power by self-weight of claim 12, wherein the backrest (70) is formed so that a lower-central portion (71) is cut out partially, a remaining portion except for a lower-central portion (71) is installed fixedly to the backrest frame (50), and the lower-central portion (71) is installed so as to be inserted and fixed to inside of the backrest inserting groove (68).

16. The chair with improved waist bearing power by self-weight of claim 1, wherein the backrest (70) is formed so that a lower-central portion (71) is cut out partially, a remaining portion except for a lower-central portion (71) is installed fixedly to the backrest frame (50), and the lower-central portion (71) is installed so as to be inserted and fixed to inside of the backrest inserting groove (68).

* * * * *